US009033548B2

(12) United States Patent
Tsai

(10) Patent No.: US 9,033,548 B2
(45) Date of Patent: May 19, 2015

(54) LED LIGHT STRING

(71) Applicant: Tung Ling Wang, Taichung (TW)

(72) Inventor: Chang-Fu Tsai, Taichung (TW)

(73) Assignee: Tung Ling Wang, Taichung (TW)

( * ) Notice: Subject to any disclaimer, the term of this patent is extended or adjusted under 35 U.S.C. 154(b) by 113 days.

(21) Appl. No.: 13/892,310

(22) Filed: May 13, 2013

(65) Prior Publication Data

US 2014/0313723 A1 Oct. 23, 2014

(30) Foreign Application Priority Data

Apr. 23, 2013 (TW) ..... 102207373 U

(51) Int. Cl.

| | |
|---|---|
| ***F21V 23/06*** | (2006.01) |
| ***F21S 4/00*** | (2006.01) |
| ***F21V 21/002*** | (2006.01) |
| *F21Y 101/02* | (2006.01) |

(52) U.S. Cl.

CPC ..... *F21V 23/06* (2013.01); *F21S 4/001* (2013.01); *F21V 21/002* (2013.01); *F21Y 2101/02* (2013.01)

(58) Field of Classification Search

CPC ..... F21S 4/001; F21V 23/06; F21V 21/002; F21Y 2101/02

USPC ..... 362/249.06

See application file for complete search history.

(56) References Cited

U.S. PATENT DOCUMENTS

| | | | | |
|---|---|---|---|---|
| 4,418,973 | A * | 12/1983 | Smetana et al. | 439/168 |
| 6,123,433 | A * | 9/2000 | Chen | 362/654 |
| 7,665,863 | B2 * | 2/2010 | Tseng | 362/249.02 |
| 2005/0207151 | A1 * | 9/2005 | Aanegola et al. | 362/227 |
| 2011/0318954 | A1 * | 12/2011 | Lin | 439/366 |

* cited by examiner

*Primary Examiner* — Nimeshkumar Patel
*Assistant Examiner* — Jacob R Stern
(74) *Attorney, Agent, or Firm* — Andrew C. Cheng

(57) ABSTRACT

An LED light string includes a socket, electrical wires, and an LED-based luminous element. The LED luminous element has two conductive terminals respectively set in abutting contact with or to pierce through the electrical wires. The socket is composed of two unsymmetrical casing members. The electrical wires and the luminous element are first placed in the first casing member and then, the second casing member is fit to and attached to the first casing member. Ultrasonic wave is then applied to achieve secure coupling of the light string.

10 Claims, 5 Drawing Sheets

LED LIGHT STRING

BACKGROUND OF THE INVENTION

1. Field of the Invention

The present invention relates to an LED (Light-Emitting Diode) light string, and in particular to a light string that has a simple structure composed of a socket, conductive wires, and an LED based luminous element.

2. The Related Arts

A conventional light string comprises, in structure, generally five components including a light bulb, a bulb holder, a socket, conductive terminals, and electrical wires. Assembly is carried out by first stamping and bending the terminals to position against the electrical wires. Then, the sub-assembly of the terminals and the electrical wires is fit into the socket. The light bulb and the bulb holder are assembled together and the holder and the socket are coupled to complete the assembly of the light string.

Another conventional light string has an assembled configuration comprising a light bulb, solders, adhesives, electrical wires, and an enclosure film. Firstly, the insulation jackets of the electrical wires are partially stripped off to partially expose conductive cores of the wires. Conductive terminals of the bulb are soldered to the exposed conductive cores of the wires and covered with the adhesive for improved security. Finally, enclosure is effected by using the enclosure film to securely fix a lower portion of the bulb and the electrical wires together.

The structure and assembling described above are generally carried out manually. This is time consuming and human errors often occur in carrying out the assembling operation, leading to high rate of defect products. In addition, the components used and the process of assembling involved are relatively numerous, leading to inevitable increase of material cost and assembling operations and thus making the manufacturing management complicated.

Prior art reference is also known, such as U.S. patent application Ser. No. 13/423,870. The present invention is made to provide further improvement over U.S. patent application Ser. No. 13/423,870.

SUMMARY OF THE INVENTION

An object of the present invention is to provide a light string that comprises a socket, electrical wires, and an LED-based luminous element. The luminous element comprises two conductive terminals that are set in electrical connection with conductive cores of the electrical wires, both being held in position by being clamped by the socket to thereby complete the assembly of the light string. With such an arrangement, the assembling of the electrical wires and the luminous element can be simplified without application of solders or adhesives or additionally provided conductor elements. As such, the parts are simplified and the cost is reduced. The overall structure is suit for being manufactured with automatic machines, requiring no human labor involved, so as to effectively eliminate flaws caused by human errors and also to help simplify manufacturing management.

Another object of the present invention is to provide a light string, which comprises a socket composed of two unsymmetrical casing members. Electrical wires and an LED-based luminous element are placed in the first casing member and then the second casing member is fit and thus mounted to the first casing member. The casing members are securely fixed together by fusion induced by application of ultrasonic wave.

A further object of the present invention is to provide a light string comprising first and second casing members respectively forming inter-engageable raised and recessed structures including holes and corresponding protrusions and tiny bosses that are fusible by application of ultrasonic wave. The first casing member forms a channel for receiving electrical wires and the second casing member forms wire hold-down blocks and terminal holding blocks that are engageable and hold the electrical wires in position so that when the casing members are fused together with the application of ultrasonic wave, the insulation jacket or conductive core of the electrical wire is securely pressed down and fixed to improve resistance against stretching of the wire and prevent the luminous element from being easily detached.

A further object of the present invention is to provide a light string that comprises first and second casing members that are respectively provided with projecting portions that are combinable with each other. The projecting portion of the first casing member forms two grooves for receiving conductive terminals of an LED based luminous elements therein to electrically connect to conductive cores of electrical wires and a rib arranged between the two grooves. The second casing member comprises a slot corresponding to and receiving the rib therein. The rib divides the channel of the first casing member into two separated sections thereby providing an insulation effect between the conductive cores of the electrical wires.

A further object of the present invention is to provide a light string, wherein a first casing member forming a wire receiving channel that has a C-shaped cross-section that is greater than a semicircle so as to clamp and retain a wire in position when the wire is placed into the channel for precisely positioning the components during the operation of ultrasonic fusion.

Yet a further object of the present invention is to provide a light string, wherein conductive terminals of an LED-based luminous element are arranged for excellent electrical connection with conductive cores of electrical wires by abutting, piercing, or piercing then wrapping.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

A detailed description will be given to discuss the structural features and other advantages and objects of the present invention with reference to the accompanying drawings.

Figure 1:
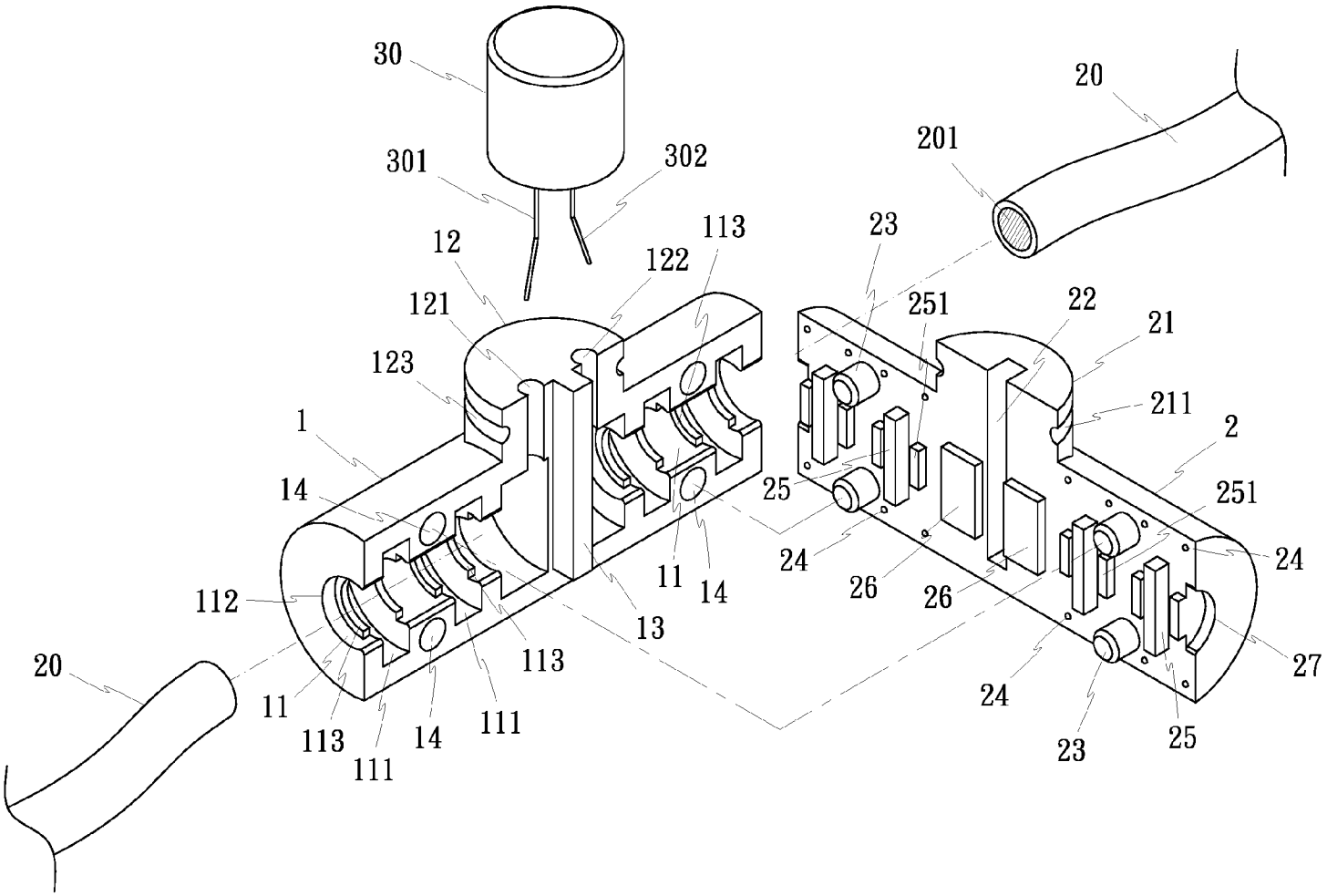
FIG. 1 is an exploded view of a light string according to the present invention.
Figure 2:
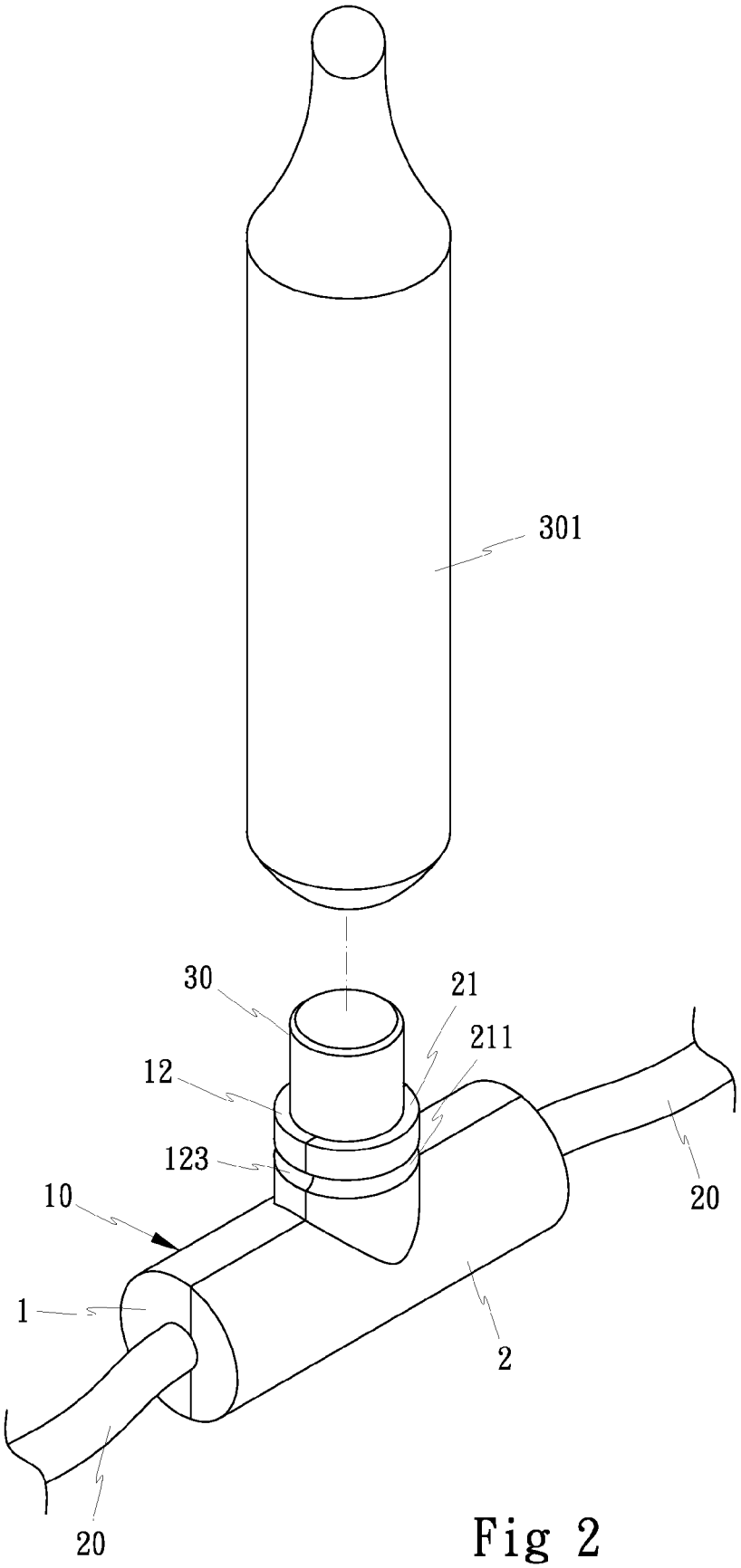
FIG. 2 is a perspective view showing the light string of the present invention with a cover detached therefrom.

As shown in FIGS. 1 and 2, the present invention provides an LED light string, which comprises a socket 10, conductive wires 20, and an LED-based luminous element 30. The socket 10 comprises two casing members 1, 2, which will be respectively referred to as "first casing member 1" and "second casing member 2" hereinafter. The first and second casing members 1, 2 are unsymmetrical to each other and are made of a thermally fusible material, preferably a material that is fused by application of ultrasonic wave, such as plastics, so as to securely joint to each other to form the complete configuration of the socket 10. The socket 10 is preferably of a generally cylindrical configuration and comprises a sideway projection that is generally cylindrical and extends radially from a circumferential surface of the cylindrical socket 10.

The first casing member 1 is a channel-like member having a first surface, which is preferably planar, facing the second casing member 2. A channel 11 is formed in the first surface of the first casing member 1 and extends in an axial direction of the cylindrical socket 10. A projecting portion 12 that constitutes partially the sideway projection of the socket 10 is formed on and extends from a curved surface of the first casing member 1. The projecting portion 12 has a planar surface that continues from and is substantially flush with the first surface of the first casing member. The planar surface of the projecting portion 12 forms two spaced grooves 121, 122 extending substantially in the radial direction of the cylindrical socket 10 from a free end of the projecting portion 12 to the interior of the channel 11 so as to be in communication with the channel 11. A raised rib 13 is formed on the planar surface of the projecting portion 12 and is located between and separating the two grooves 121, 122 to provide an effect of isolating the two grooves 121, 122 from each other. The rib 13 is arranged to radially extend through the channel 11 so as to divide the channel 11 into two separate sections. A plurality of retention holes 14 is formed in the first surface of the first casing member 1.

The second casing member 2 is of a lid-like member having a shape or configuration that, when mating with the channel-like first casing member 1, complete a cylindrical configuration of the socket 10. The second casing member 2 has a second surface, which is preferably planar and is surface-to-surface engageable with the first surface of the first casing member 1 to close the channel 11. The second casing member 2 has a curved surface on which a projecting portion 21 is formed to correspond to the projecting portion 12 of the first casing member 1, whereby when the first and second casing members 1, 2 are jointed to each other to form the cylindrical socket 10, the curved surfaces of the first and second casing members 1, 2 collectively form the circumferential surface of the cylindrical socket 10 and the projecting portions 12, 21 mate each other to form the sideway projection of the socket 10. The projecting portion 21 of the second casing member 2 has a planar surface mating the planar surface of the projecting portion 12 of the first casing member 1 and comprising a slot 22 that corresponds to and receives the rib 13 of the first casing member 1 therein when the first and second casing members 1, 2 are jointed to each other. Also, when the first and second casing members 1, 2 are jointed to each other, the planar surface of the projecting portion 21 of the second casing member 2 close the grooves 121, 122 of the projecting portion 12 of the first casing member 1 to form two insertion holes for receiving insertion of conductive terminals 301, 302 of the LED-based luminous element 30 therein. A plurality of retention protrusions 23 is formed on the second surface of the second casing member 2 and is receivable in the retention holes 14 of the first casing member 1. A plurality of tiny bosses 24 is also formed on the second surface of the second casing member 2 to be in contact with the first surface of the first casing member 1 when the first and second casing members 1, 2 are jointed and is fusible by the application of ultrasonic wave to securely fix the first and second casing members 1, 2 together.

End portions of two conductive wires 20 are respectively fit in the two sections of the channel 11 of the first casing member 1. The wires 20 can be temporarily held in position in the channel 11. The conductive terminals 301, 302 of the luminous element 30 are then placed in the grooves 121, 122 of the first casing member 1 to contact conductive cores 201 of the wires 20. The wires 20 being temporarily held in position in the channel 11 of the first casing member 1 allows an easy operation of mounting the second casing member 2 to the first casing member 1 to close the channel 11. The second casing member 2 thus securely fixes the wires 20 in the channel 11 and also retains the conductive terminals 301, 302 of the luminous element 30 in the grooves 121, 122. The first and second casing members 1, 2 are then subjected to thermal fusion with ultrasonic wave to be securely fixed together.

Figure 3:
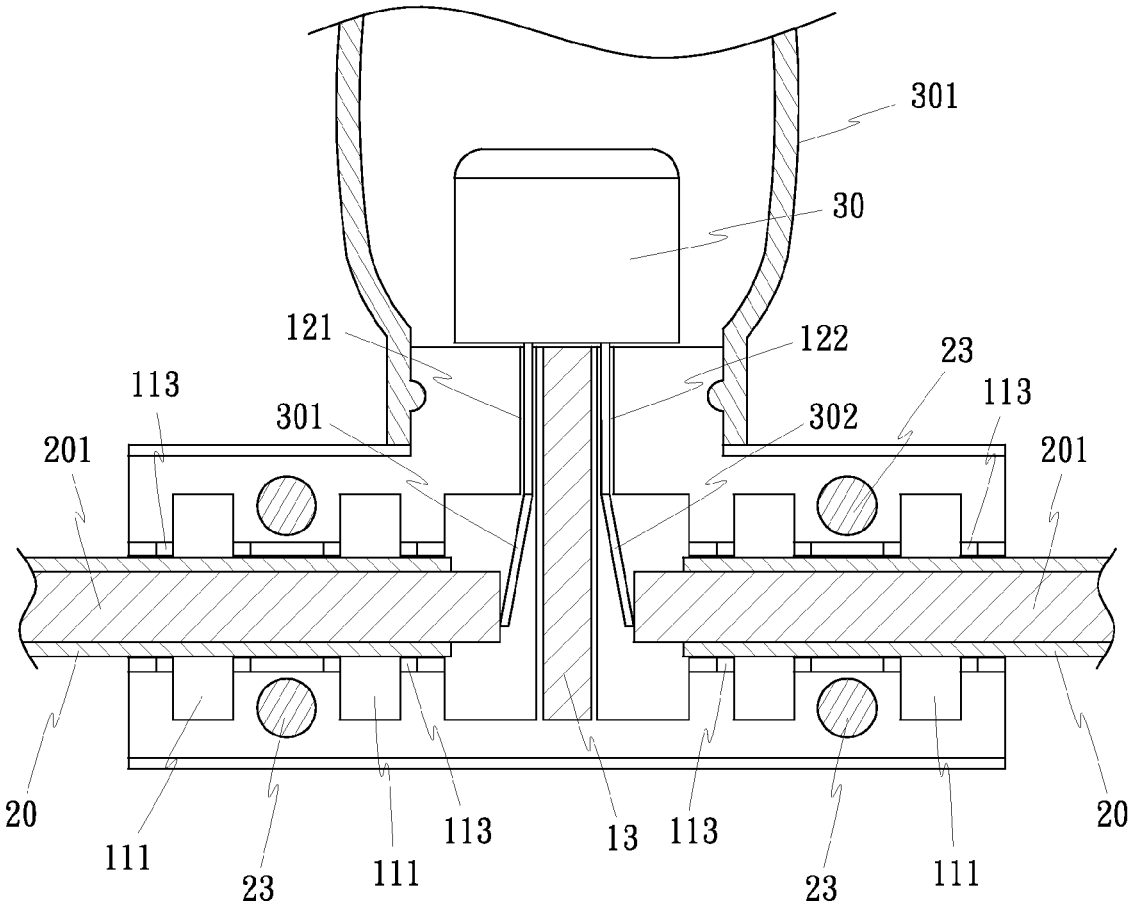
FIG. 3 is a cross-sectional view, in an assembled form, showing conductive terminals of a luminous element are held in contact with conductive cores of wires by terminal holding blocks of a socket of the light string according to an embodiment of the present invention.
Figure 4:
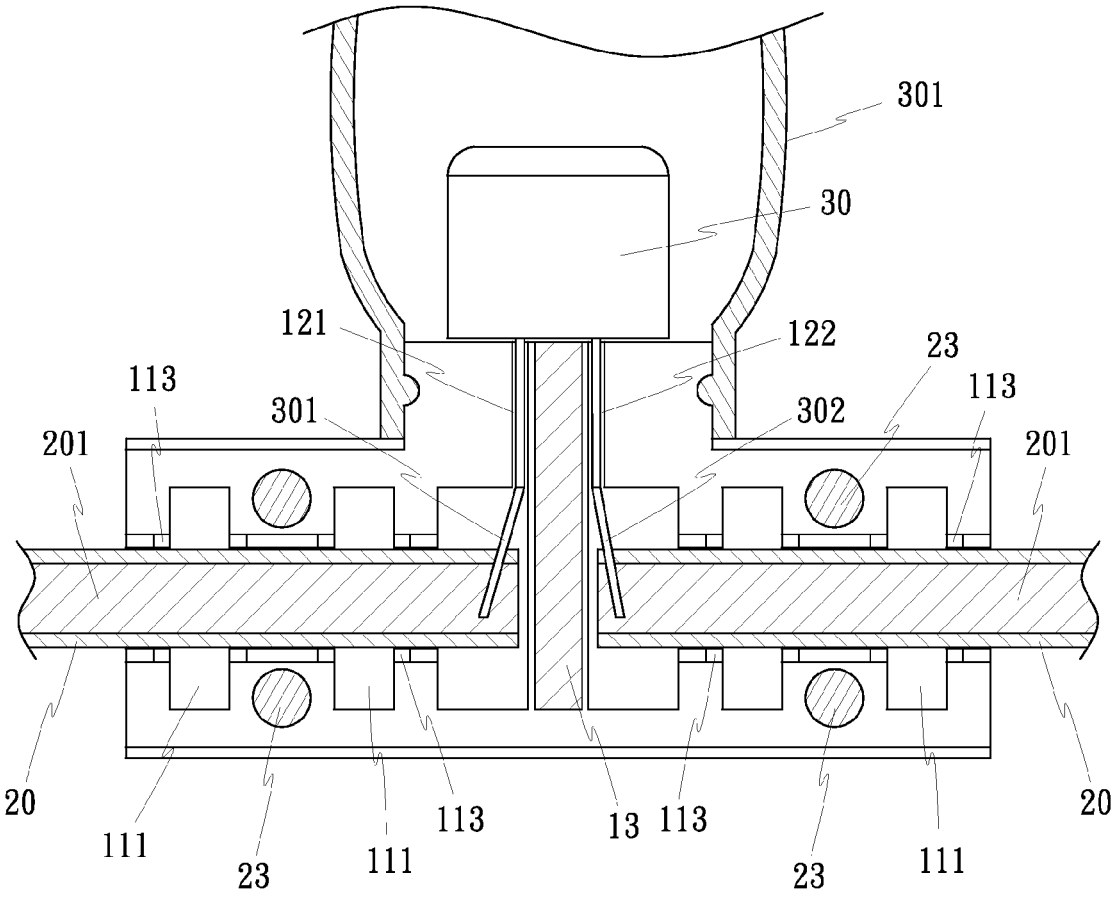
FIG. 4 is a cross-sectional view, in an assembled form, showing conductive terminals of a luminous element pierce through wires to contact conductive cores of the wires according to another embodiment of the present invention.

As shown in FIGS. 3 and 4, the projecting portions 12, 21 of the first and second casing members 1, 2 are respectively provided with circumferentially extending recesses 123, 211 that, when the casing members 1, 2 are jointed together to form the socket 10, collectively form a circumferential recess around the sideway projection of the socket 10. The circumferential recess of the sideway projection of the socket 10 receives and a corresponding rim of a cover 301 of the luminous element 30 so as to retain the cover 301 on the sideway projection of the socket 10.

The channel 11 of the first casing member 1 is provided, on an interior surface thereof, with a plurality of semi-circular flanges 113, each defining a concave recess substantially concentric with the channel 11 but having a smaller inside diameter. Further, notches 111 are selectively formed in the interior surface of the channel 11 and each of the notches 111 is formed by recessing the interior surface of the channel 11. Preferably, each of the notches 111 is associated with two of the flanges 113 in such a way that the two flanges 113 are located on opposite sides of the notch 111. The inside diameter of the concave recess of the semi-circular flange 113 is preferably slightly smaller than an outside diameter of an insulation jacket of the wire 20, whereby when the wires 20 are placed and securely fixed in the channel 11 by the first and second casing members 1, 2 fixed to each other, the flanges 113 compress, in a limited way, the insulation jackets of the wires 20 so as to more securely fix the wires 20 in position and provide good resistance against stretching of the wires 20.

The second casing member 2 is provided with a plurality of wire hold-down blocks 25 respectively corresponding to the notches 111 of the first casing member 1. With the wires 20 being placed in the channel 11 of the first casing member 1, when the second casing member 2 is mounted to the first casing member 1, the wire hold-down blocks 25 compress and deform the insulation jackets of the wires 20. The notches 111 allow the wires 20 to be slightly deformed by the blocks 25. The wire hold-down blocks 25 may provide a "pinching" or "biting" effect on the wires 20 to securely hold the wires in position. The wire hold-down blocks 25, as well as the flanges 113, provide excellent resistance against stretching of the wires 20.

The second casing member 2 is also provided with two terminal holding blocks 26 on two sides of the slot 22 to press and hold the conductive terminals 301, 302 of the luminous element 30 and the conductive cores 201 of the wires 20 in engagement with each other in order to prevent the luminous element 30 from being easily removed from the socket 10.

The channel 11 of the first casing member 1 is preferably of a cross-sectional shape that is a major circular sector or a C-shape 112 that is greater than a semicircle or, in other words, having a central angle greater than 180 degrees, so that the wire 20, when placed in the channel 11, can be temporarily held by the C-shape. The second casing member 2 may be provided with a sector-shaped opening 27 complementary to the C-shaped cross-section 112 of the channel 11 for forming a circular opening in which the wire 20 is received.

The second surface of the second casing member 2 can be slightly recessed with a sectorial cross-section corresponding to the opening 27, instead of a planar surface as discussed above. The sectorial opening 27 is complementary to the C-shaped channel 11.

Secondary hold-down blocks 251 may be provided on the second surface of the second casing member 2, preferably on opposite sides of each or some of the wire hold-down blocks 25 to further increase the resistance against stretching of the wires 20.

As shown in FIG. 3, the conductive terminals 301, 302 of the luminous element 30 are positioned in the grooves 121, 122 of the first casing member 1 to contact with the conductive cores 201 of the wires 20. The conductive terminals 301, 302 of the luminous element 30 and the conductive cores 201 of the wires 20 are held in position, in secure engagement with each other, by the terminal holding blocks 26 to ensure electrical connection therebetween.

Alternatively, as shown in FIG. 4, the conductive terminals 301, 302 of the luminous element 30 can be arranged to pierce into the wires 20 to electrically connect to the conductive cores 201.

Figure 5:
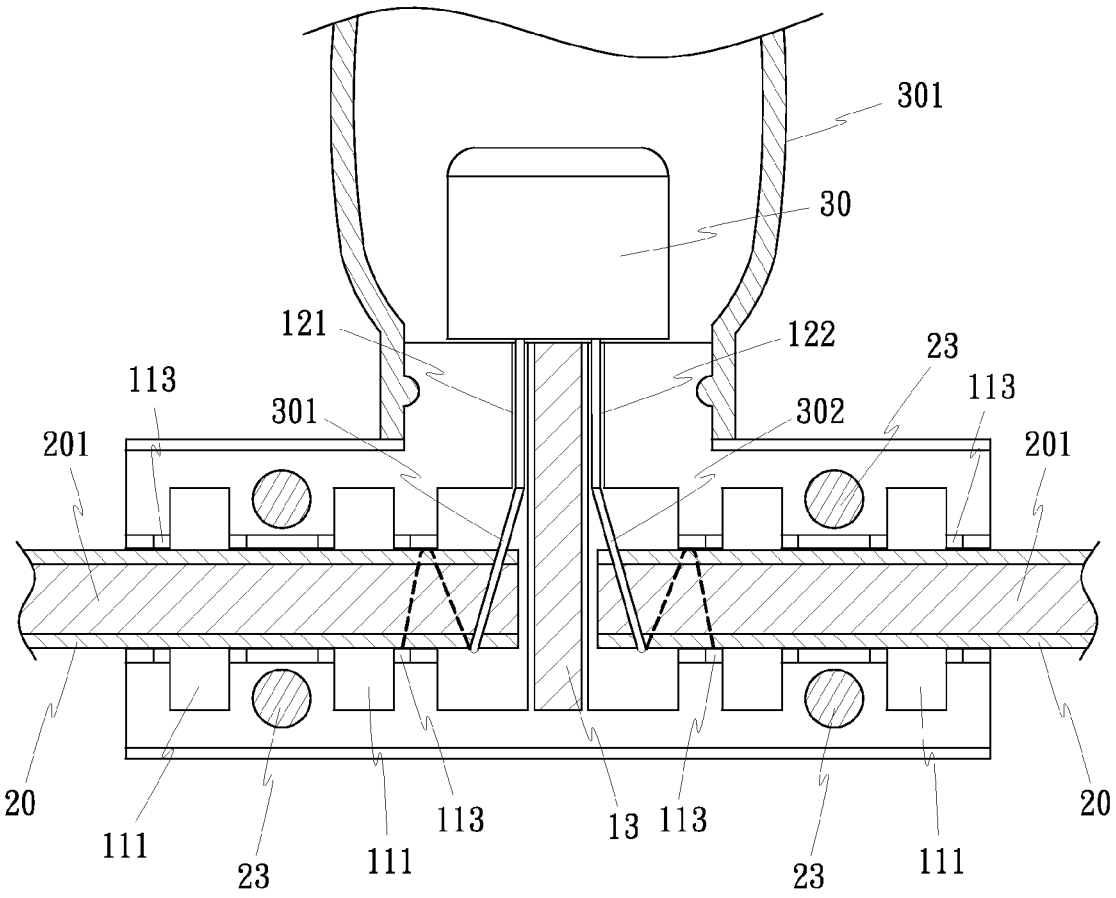
FIG. 5 is a cross-sectional view, in an assembled form, showing conductive terminals of a luminous element pierce through wires to contact conductive cores of the wires and wrapped around the wires according to a further embodiment of the present invention.

Or alternatively, as shown in FIG. 5, the conductive terminals 301, 302 of the luminous element 30 can be arranged to pierce through the wires 30 to physically contact the conductive cores 201 and are further wrapped around the wires 20 to provide a secure coupling therebetween.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An LED light string, comprising a socket, two separate electrical wires each having a conductor core, and an LED-based luminous element, the socket comprising a first casing member and a second casing member that are unsymmetrical to each other and are made of a fusible material, the LED-based luminous element comprising two conductive terminals;

wherein the first casing member has a first jointing surface in which a channel is formed, the channel comprising two isolated channel sections for respectively receiving the two electrical wires therein with the conductor cores being isolated from each other, the first casing member comprising a first projecting portion formed on and extending in a predetermined direction from a side surface thereof, the first projecting portion forming two spaced straight grooves that extend in the predetermined direction completely through the first projection portion to each define an opening in a top of the first projection and to respectively communicate with the two isolated channel sections and a rib arranged between the two grooves to separate the two grooves from each other, the first casing member comprising retention holes formed in the first jointing surface;

wherein the second casing member has a second jointing surface that is jointed to the first jointing surface so that the first and second casing member collectively form the socket, the second casing member comprising a second projecting portion formed on and extending from a side surface thereof, the second projecting portion forming a slot in which the rib of the first projecting portion is receivable, the second casing member comprising a plurality of retention protrusions formed on the second jointing surface to be respectively receivable in the retention holes of the first casing member, the second casing member comprising a plurality of bosses formed on the second jointing surface and adapted to be fused by application of ultrasonic energy for jointing the first jointing surface; and wherein the electrical wires are received in the two isolated channel sections of the channel of the first casing member in such a way that inner end portions of the two electrical wires that comprise exposed portions of the conductor cores are at locations respectively and directly corresponding to the grooves of the first casing member and the two conductive terminals of the luminous element are respectively received through the grooves of the first projecting portion of the first casing member to directly contact with, and thus be in electrical connection with the conductive cores of the electrical wires, the second casing member being then mounted to the first casing member to close the channel and the grooves to hold the electrical wires and the luminous element in position, the second casing member being securely fixed to the first casing member through fusion induced by application of ultrasonic energy.

2. The LED light string as claimed in claim 1, wherein when the first and second casing members are jointed to each other to form the socket, the first and second projecting portions are jointed to each other to collectively form a sideway projection of the socket, each of the first and second projecting portions comprising a circumferentially-extending recess, the circumferentially extending recesses being jointed together to form a circumferential recess of the sideway projection for receiving and retaining therein a rim of a cover of the luminous element.

3. The LED light string as claimed in claim 1, wherein the first casing member comprises a plurality of spaced notches formed in an interior surface of the channel and the second casing member comprises a plurality of hold-down blocks corresponding to the notches.

4. The LED light string as claimed in claim 1, wherein the second casing member comprises two holding blocks on two sides of the slot that hold the conductive cores of the wires and the conductive terminals of the luminous element in contact with each other.

5. The LED light string as claimed in claim 1, wherein the channel of the first casing member has a C-shaped cross-section that is greater than a semicircle and the second casing member comprises a sectorial opening complementary to the C-shaped channel.

6. The LED light string as claimed in claim 1, wherein the second casing member comprises secondary hold-down blocks each provided at one side of the hold-down blocks.

7. The LED light string as claimed in claim 1, wherein the conductive terminals of the luminous element are held in contact engagement with conductive cores of the wires.

8. The LED light string as claimed in claim 1, wherein the conductive terminals of the luminous element pierce through the wires to contact conductive cores of the wires.

9. The LED light string as claimed in claim 8, wherein the conductive terminals of the luminous element are wrapped around the wires.

10. The LED light string as claimed in claim 1, wherein the first casing member comprises a plurality of semi-circular flanges formed on an interior surface of the channel.

* * * * *